United States Patent [19]

Kassabian

[11] Patent Number: 4,861,678

[45] Date of Patent: Aug. 29, 1989

[54] DISPLAY APPARATUS

[76] Inventor: Levon Kassabian, 1306 N. Lake, Pasadena, Calif. 91104

[21] Appl. No.: 87,095

[22] Filed: Aug. 19, 1987

[51] Int. Cl.[4] ..... A61J 9/00; B44C 3/06; G09F 19/00

[52] U.S. Cl. ..... 428/542.4; 206/45.31; 206/45.33; 215/11.1; 428/13

[58] Field of Search ..... 215/11.1, 11.5, 11.6; 428/542.4, 13; D11/133, 157; 206/45.31, 45.33

[56] References Cited

U.S. PATENT DOCUMENTS

| | | | |
|---|---|---|---|
| 1,118,134 | 11/1914 | Jones | 215/11.5 |
| 2,063,315 | 12/1936 | Kuettel | 428/542.4 X |
| 2,379,793 | 7/1945 | Eenigenburg | 428/13 X |
| 2,451,913 | 10/1948 | Brice | 428/13 X |
| 2,867,053 | 1/1959 | Boor | 428/13 X |
| 3,077,279 | 2/1963 | Mitchell | 215/11.1 |
| 3,613,265 | 10/1971 | Stern et al. | 428/13 X |
| 3,660,211 | 5/1972 | Brody | 428/13 X |
| 3,725,112 | 4/1925 | Hansen | 428/13 |
| 3,857,916 | 12/1974 | Waszkiewicz, Jr. | 428/13 X |
| 3,886,248 | 5/1975 | Nicholson | 428/13 X |
| 4,304,076 | 12/1981 | Splendora | 428/13 X |
| 4,417,613 | 11/1983 | Ryan et al. | 215/11.6 X |
| 4,526,274 | 7/1985 | Kesselring et al. | 215/11.6 X |
| 4,640,425 | 2/1987 | Cabernoch | 215/11.6 |

OTHER PUBLICATIONS

Page 91, The Title Page and Verso of Title Page of Webster's Seventh New Collegiate Dictionary G&C Merriam Co., Publishers, Springrield, Mass.

Page 41 of Boys' Life Magazine, Sep. 1976.

*Primary Examiner*—Henry F. Epstein

*Attorney, Agent, or Firm*—Louis J. Bachand

[57] ABSTRACT

Memento display apparatus comprising a solid transparent resin cube and embedded therein a baby's nipple or other personal childhood keepsake away from the atmosphere for preservation.

8 Claims, 1 Drawing Sheet

DISPLAY APPARATUS

TECHNICAL FIELD

This invention has to do with apparatus for the display of personal momentos. More particularly, the invention relates to display apparatus for enclosing and preserving from deterioration in the atmosphere personal keepsakes and momentos such as baby nipples, teething rings, and pacifiers, and their associated supports.

BACKGROUND

There presently exists no entirely suitable means of preserving for memory and from the atmosphere those symbols of childhood as personal as baby bottle nipples, teething rings and pacifiers and like devices.

SUMMARY OF THE INVENTION

It is accordingly an object of the present invention to provide means for preserving for memory and from the atmosphere such childhood keepsake devices as baby bottle nipples, teething rings and pacifiers, in which the device is perfectly displayed, and totally protected from deterioration by contact with the atmosphere. It is another object to provide apparatus for the attractive and preserving display of such childhood keepsakes, it being intended that the baby items be sealed in a display enclosure after their period of usefulness is over. It is a further object to provide such apparatus for display and preservation of such devices reminescent of the actual devices when the owner's actual devices have been discarded.

These and other objects of the invention to become apparent hereinafter are realized in the momento display apparatus comprising a baby's feeding nipple or like device, a support therefor, and a rigid transparent plastic airtight enclosure enclosing the device and support away from the atmosphere in displaying relation.

In particular embodiments, the device and support are assembled together as for use by a baby; the enclosure comprises an acrylic resin; and the enclosure is generally a cube.

In another embodiment of the invention momento display apparatus, the device is a rubber nipple, the support mounts the nipple in projecting relation, and the support and nipple are engaged. Typically in this embodiment, the enclosure comprises an acrylic resin; the enclosure is a cube, the engaged nipple extending within the enclosure; and, the enclosure cube is solid around and within the nipple and support.

In yet another embodiment the invention provides a momento display apparatus comprising a solid cube of transparent plastic and embedded therein a personal childhood keepsake, such as a baby bottle nipple and holder, a teething ring and/or pacifier.

BRIEF DESCRIPTION OF THE DRAWINGS

The invention will be further described in conjunction with the attached drawing in which.

DETAILED DESCRIPTION

Figure 3:
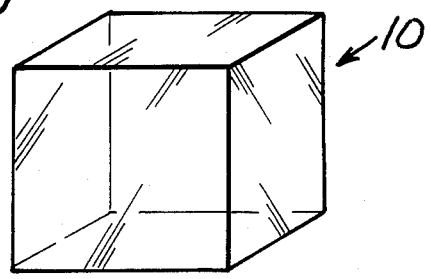
FIG. 3 is a perspective view of the cube enclosure, shown without the keepsake within for clarity of illustration.

With reference now to the drawings in detail, in FIG. 3 a cube 10 of transparent resin is depicted of the type used to form the enclosure aspect of the present apparatus. Typical resins used are the acrylic monomer based resins, such as poly methyl methacrylate, but others including styrene monomer based resins and polycarbonate resins and others having the requisite degree of transparency, rigidity and castability are useful. Other shapes than cube can also be used such as spheres, and rectangles.

Figure 1:
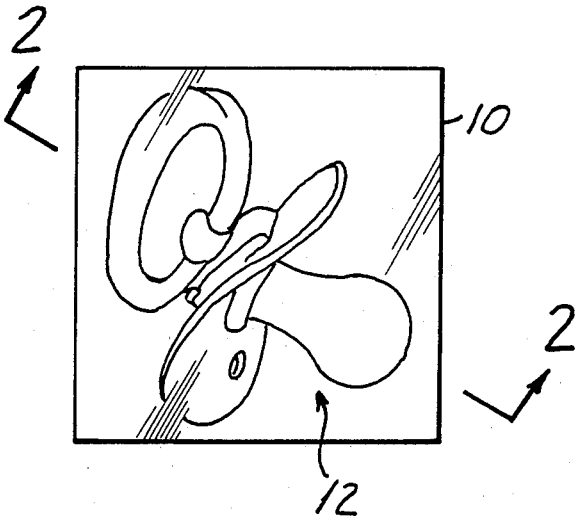
FIG. 1 is a front elevational view of the display apparatus.
Figure 2:
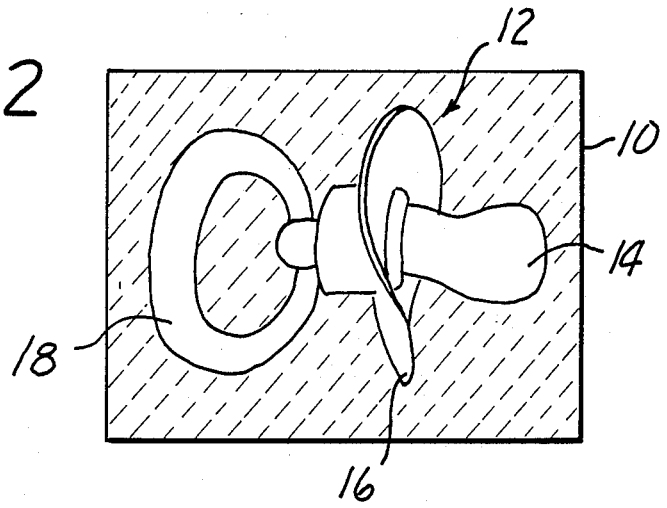
FIG. 2 is a view taken on line 2—2 in FIG. 1.

The childhood keepsake to be displayed and preserved is typically a device such as a nipple, teething ring or pacifier. An illustrative keepsake device is shown at 12 in FIGS. 1 and 2, embedded in the cube 10. Keepsake device 12 comprises a nipple 14, a nipple support 16, and a teething ring 18, all assembled together, but separate ones of these devices can be used.

The keepsake device is cleaned as desired, placed in a receiving mold and the resin is cast about the keepsake, suitably as a solution in an appropriate solvent, taking care to avoid air entrapment. After the resin hardens the apparatus is removed from the mold.

There is obtained a momento apparatus comprising the transparent cube and on display therein the childhood keepsake, forever on view and preserved for the ravages of the atmosphere and the hazards of loss or inadvertent destruction.

The foregoing objects of the invention are thus met.

I claim:

1. Momento display apparatus comprising a baby's feeding nipple, teething ring or pacifier device, an integrally formed support therefor, and a solid rigid transparent plastic airtight enclosure embedding said device supported by said support and away from the atmosphere in displaying relation.

2. Momento display apparatus according to claim 1, in which said nipple and support are assembled together as for use by a baby.

3. Momento display apparatus according to claim 1, in which said enclosure comprises an acrylic resin.

4. Momento display apparatus according to claim 1, in which said enclosure is generally a cube.

5. Memento display apparatus according to claim 1, in which said device is a rubber nipple, said support mounts said nipple in projecting relation, and said support and nipple are engaged.

6. Memento display apparatus according to claim 5, in which said enclosure comprises an acrylic resin.

7. Memento display apparatus according to claim 6, in which said enclosure is a cube, said engaged nipple extending within said enclosure.

8. Memento display apparatus according to claim 7, in which said enclosure cube is solid around and within said nipple and support.

* * * * *